United States Patent [19]

Sie

[11] 4,215,632

[45] Aug. 5, 1980

[54] EXERCISE PROJECTILE, MORE ESPECIALLY OF THE DISCARDING SABOT TYPE

[75] Inventor: Swan L. Sie, Zaandam, Netherlands

[73] Assignee: Eurometaal N.V., Zaandam, Netherlands

[21] Appl. No.: 906,658

[22] Filed: May 16, 1978

[51] Int. Cl.[2] ..... F42B 13/20

[52] U.S. Cl. ..... 102/92.7; 102/93

[58] Field of Search ..... 102/49.4, 49.5, 92.7, 102/93; 244/3.26

[56] References Cited

U.S. PATENT DOCUMENTS

| | | | |
|---|---|---|---|
| 2,055,765 | 9/1936 | Hayden | 244/3.25 |
| 2,655,105 | 10/1953 | Hansche | 102/49.4 |
| 3,064,381 | 11/1962 | Vilbajo | 102/65.2 |
| 3,186,342 | 6/1965 | Hancock, Jr. | 102/93 |
| 3,580,179 | 5/1971 | Gawlick et al. | 102/93 |
| 3,991,682 | 11/1976 | Peak | 102/93 |
| 4,140,061 | 2/1979 | Campoli | 102/92.7 |

*Primary Examiner*—David H. Brown
*Attorney, Agent, or Firm*—John P. Snyder

[57] ABSTRACT

An exercise projectile of the discarding sabot type and having a projectile body consisting of at least two parts which, after traversing a predetermined trajectory, are separated from one another and are provided with first and second connecting means for keeping these parts interconnected prior to firing and during the predetermined trajectory, respectively, and with disconnecting means for rendering the connecting means inoperative at least at or near the predetermined trajectory. The first connecting means comprise means cooperating with the sabot, like collars engaging in grooves of the sabot. The second connecting means are of the type activated by the firing of the projectile, e.g. of pneumatic type, like gas pressure interlocking means which, during the predetermined trajectory, are kept under a gas pressure derived from the firing gas pressure and are reduced during the predetermined trajectory by suitable means, like leakage ducts.

10 Claims, 3 Drawing Figures

FIG. 1
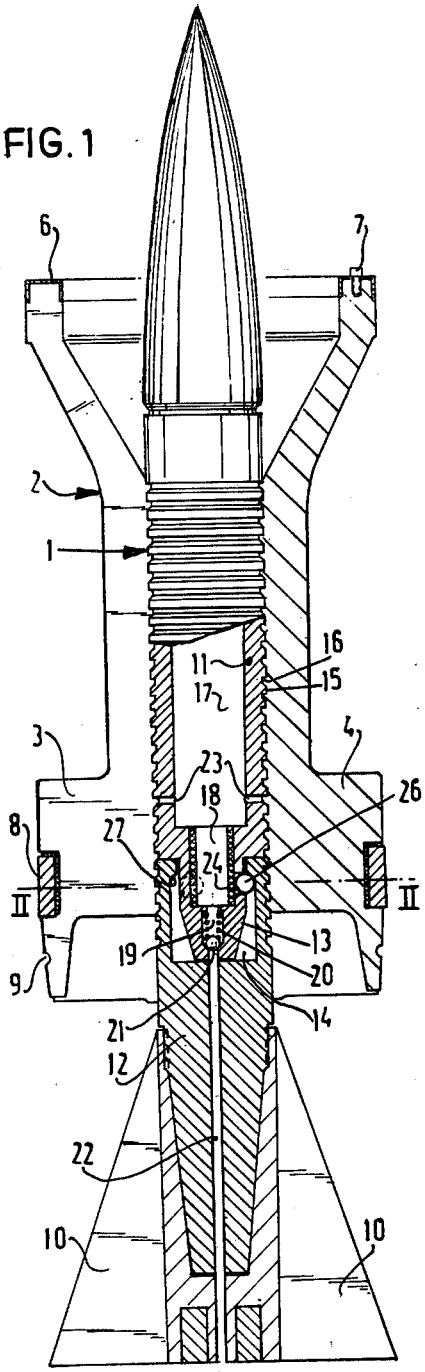
FIG. 2
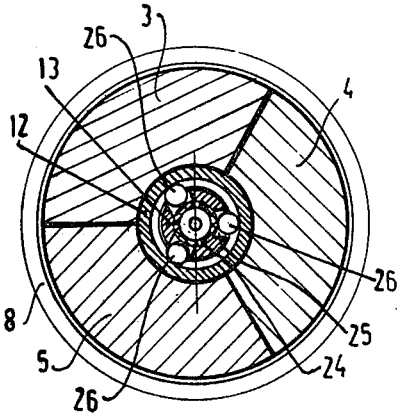
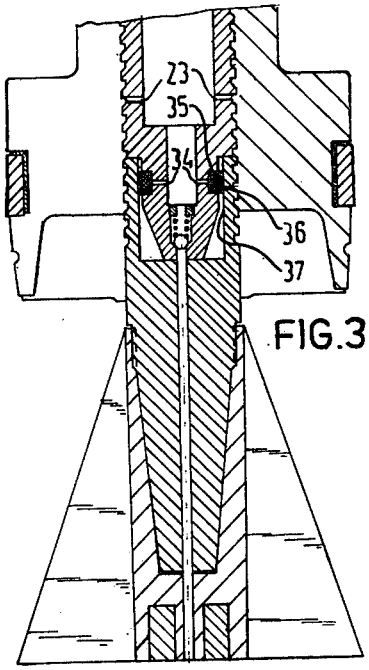
FIG. 3

EXERCISE PROJECTILE, MORE ESPECIALLY OF THE DISCARDING SABOT TYPE

This invention relates to an exercise projectile, the projectile body of which consists of at least two parts which, after traversing a predetermined trajectory, are separated from one another in such a manner that the resulting change in the ballistic behaviour of the projectile body prevents or counteracts any further flight, those parts which are to be separated from one another being provided with first connecting means which keep the parts interconnected prior to and, if required, during firing, second connecting means which keep the parts interconnected during the predetermined trajectory, and disconnecting means which render the connecting means inoperative at least at or near the end of the predetermined trajectory.

An exercise projectile of this kind, in which the first and the second connecting means coincide, is disclosed by German Patent published application No. 734,429 and generally serves to satisfy the requirement of having, during the exercise distance, the same trajectory and same flight time as a warhead projectile of comparable type but, after traversing the exercise distance, falls to the ground as quickly as possible, so that the area in which the projectile may be dangerous is as restricted as possible. This latter aspect becomes increasingly important as exercise facilities become decreasingly available. For example, an exercise distance of 2,000 meters and a maximum range of 7,500 meters is desirable for a specific type of exercise projectile.

The object of the invention is to provide an exercise projectile of the discarding sabot type which satisfies such requirements. A projectile type of this kind, which may be provided with stabilizer fins on its tailpiece, is provided with a discarding sabot for guidance in the gun barrel, such sabot being separated from the projectile body after firing, so that the projectile body, which has a favourable aerodynamic configuration, continues to fly on alone. Projectiles of this type are becoming increasingly used as tank ammunition.

According to the invention, in the case of an exercise projectile of the discarding sabot type, which is separated from the projectile body after firing, the first connecting means comprise means which co-operate with the sabot to keep the separable parts of the projectile body interconnected. The fact that the discarding sabot is separated from the projectile immediately after firing is utilized, on the one hand, to ensure that there is no premature undesirable separation of the parts from the projectile body and, on the other hand, to make its application unnecessary in respect of separate disconnecting means which would in turn have to render the first connection means inoperative.

In a very practical embodiment of the invention, the first connecting means comprise means which belong to the sabot and which, for connection, co-operate with means belonging to the separable parts of the projectile body. For example it is possible for the co-operating means to comprise grooves on the one hand and collars engaging therein on the other hand.

It should be noted that U.S. Pat. No. 3,620,167 for example, already discloses a warhead projectile of the discarding sabot type in which the sabot and the projectile body are respectively already provided with such grooves and collars but which do not function as connecting means for retaining two separable parts of the projectile body together.

It will be apparent that the presence of the sabot prior to and during the firing of the exercise projectile according to the invention permits good interconnection of the subsequently separated parts of the projectile body but that the second connecting means should operate thereafter. According to the invention, the second connecting means are of the type activated by the firing of the projectile. Although the use of other means is not excluded, in a preferred embodiment of the exercise projectile according to the invention, the second connecting means are of the pneumatic type and the second connecting means are provided for example with gas pressure interlocking means which, during the predetermined trajectory, are kept under a gas pressure derived from the firing gas pressure.

In this connection it should be noted that French Patent No. 1,179,751 discloses a warhead projectile of the discarding sabot type in which ejection of the discarding sabot takes place by means of a gas pressure derived from the firing gas pressure of the projectile. However, there is no reference to any use and maintenance of such gas pressure derived from the firing gas pressure during the further trajectory of the projectile as in the case of the exercise projectile according to the invention.

To render the second connecting means inoperative, according to the invention, the disconnecting means are of the type which operate with a delay mechanism and which are activated by the activation of the second connecting means. Although it is possible to use other means, e.g. pyrotechnic means, it is preferred according to the invention for the disconnecting means to be of the pneumatic type, for which purpose the disconnecting means may, for example, be provided with gas pressure reducing means which are operative, in the predetermined trajectory, to reduce the gas pressure operative on the gas pressure interlocking means.

In a practical embodiment of the exercise projectile according to the invention, for example, the two parts of the projectile body which are situated substantially in extension of one another are arranged with one part having a portion projecting telescopically into the other and at least one of the two parts has an internal pressure cavity which leads via an axial duct containing a non-return valve to the rear of the tailpiece of the projectile body and communicates with one or more radially movable means which, in the radially outward position, provide the connection between the two parts of the projectile body and, in the radially inwards position, allow disconnection of the two parts while the pressure cavity communicates, via one or more calibrated leakage ducts, with the exterior of the projectile body.

In a structurally simple embodiment of such a design, according to the invention, the telescopic portion of one part of the projectile body has one or more recesses at its outer circumference, in which a radially displaceable member is always accommodated, while the bottom of each recess is constructed for transmission of a radially outward force exerted by the gas pressure inside the pressure cavity to the member which, in its radially outward position, acts on the interior of the other part of the projectile body.

In another aspect of the invention in these circumstances, the radially displaceable body is formed by a ring of elastic material disposed in a circumferential groove in the telescopic portion of one part of the projectile body, one or more ducts which communicate with the pressure cavity leading into the base of the groove, via which ducts the ring can be expanded in the radially outward direction so that the ring is brought into frictional engagement with the interior of the other part of the projectile body.

In another aspect of the invention, the radially displaceable body is formed by a ball of incompressible material which is accommodated in a recess in the telescopic portion of one part of the projectile body and which, at its radially inwardly situated side, bears against a plate-shaped body held against its inside under the gas pressure inside the pressure cavity, while at its radially outwardly situated side it bears against an oblique internal abutment surface of the other part of the projectile body. In order to maintain good rotational symmetry of the projectile body, preferably, it is provided with a number of balls distributed uniformly over the outer circumference of the telescopic portion and bearing, at their radially inwardly situated side, on a radially compressible cylindrical body, the interior of which belongs to the pressure cavity.

The invention will be explained below with reference to the accompanying drawing showing a number of embodiments, to which the invention is not restricted.

In the drawing:

FIG. 1 is a diagram partially in axial section showing a first embodiment of an exercise projectile according to the invention, FIG. 2 is a cross-section on the line II—II in FIG. 1, and FIG. 3 is a similar view to FIG. 1 showing a part of a second embodiment of an exercise projectile according to the invention.

As already stated, the invention relates to an exercise projectile of the type having a discarding sabot which, during firing, serves to guide the projectile inside the gun barrel and, after firing, is separated from the projectile body. Also as already stated, the invention does not relate to the ballistic behaviour of the projectile body within the first part of the trajectory. It will simply be assumed hereinafter that the projectile body has a mass distribution such that the exercise projectile has the same ballistic behaviour as a warhead projectile over the trajectory covering the exercise distance.

The exercise projectile shown in FIG. 1 consists essentially of a projectile body having the general reference 1 and the discarding sabot having the general reference 2. The discarding sabot 2 consists of three parts 3, 4, 5 which are substantially in the form of segments of a circle and which fan out to the shape of a bowl at the front, where they are retained by means of a ring 6, together with bolts 7 if required. The parts 3, 4 and 5 of the sabot 2 are also retained by a circumferential ring 8 at some distance from their rear end. A circumferential groove 9 situated even farther towards the rear end serves to accommodate the front edge of a projectile case (not shown) which contains the charge for firing and expulsion of the projectile and which does not form part of the invention.

Insofar as they relate to the normal operation of the sabot during and after the firing of a projectile, no further details of the sabot 2 will be given, because they do not form part of the invention. It should simply be pointed out that after the projectile has been fired the discarding sabot 2 is separated from the projectile body 1 by the effect of the ambient air on the said bowl shape, so that the projectile body 1 continues its trajectory as a unit.

The stabilizer fins 10 shown in FIGS. 1 and 3 do not form part of the invention either. Embodiments both with and without stabilizer fins are possible with the discarding sabot type of projectile described here.

In the embodiments described here, the projectile body 1 can consist of two parts 11 and 12 which are shown with different cross-hatching in the drawing. As will be explained hereinafter, these parts 11 and 12 are separated from one another after a predetermined trajectory has been covered, so that the resulting change in the ballistic behaviour of the projectile body prevents or counteracts further flight of the parts 11 and 12.

In the embodiments of the invention shown in the drawing, the rear end of part 11 of the projectile body projects telescopically by a part 13 and with some play into a cavity 14 in the rear part 12 of the projectile body.

In order that the two parts 11 and 12 of the projectile body 1 may be held in the connected state prior to and during the firing of the projectile, the two parts are provided with projecting collars 15 at their circumference, such collars being enclosed by matching circumferential grooves 16 on the inside of the sabot parts 3, 4 and 5. This construction comprising collars 15 and grooves 16 ensures that the two parts 11 and 12 remain connected during the presence of the sabot 2. Of course other constructions can be used for retaining the two parts 11 and 12. Generally, however, it is preferable for the connecting means to comprise means which cooperate with or belong to the sabot.

After the sabot 2 has separated from the projectile body 1, other means should of course come into operation to keep the two parts 11 and 12 of the projectile body interconnected, i.e. to hold the telescopic part 13 of part 11 inside the cavity 14 of part 12. To this end, in the embodiments described here, the rear end of part 11 of the projectile body has an internal pressure cavity 17 which leads, via a narrowed portion 18, to a chamber 19 containing a ball 21 biased by a spring 20, and an axial duct 22 extending from the rear of the tailpiece of the part 12 centrally within said part, to the front part of the tailpiece.

The action of the chamber 19, spring 20 and ball 21 is that of a non-return valve between the duct 22 and the pressure cavities 17 and 18. It will now be clear that in the embodiments according to FIGS. 1 and 3, which thus far pratically completely correspond with one another, when the projectille is fired a gas pressure is built up from the firing gas pressure in the gun barrel, via the duct 22, chamber 19 and the narrowed part 18, such pressure building up inside the pressure cavity 17 and being unable to escape rearwardly because of the action of the non-return valve 19, 20, 21. This gas pressure inside the pressure cavity 17 is now used, during the intended flight of the projectile body 1, to maintain the connection between the two parts 11 and 12 thereof. This intended flight naturally extends over the exercise distance. When this distance has been covered, i.e. after completion of the intended trajectory, the connection between the parts 11 and 12 should be broken as quickly as possible. For this purpose, the pressure cavity 17 communicates, via leakage ducts 23 of suitably calibrated cross-section, with the exterior of the projectile body 1. The calibration is so selected that the gas pressure inside the pressure cavity 17 has fallen, at the end of the intended trajectory, to below a value required to maintain the said connection.

In this connection it should also be noted that means other than pneumatic means, e.g. pyrotechnic means, may be used to cancel a pneumatic or some other connection between the parts 11 and 12 of the projectile body 1. The two embodiments according to FIGS. 1 and 3 are preferred embodiments of the invention, but the latter is not restricted to the pneumatic connection and disconnection of the parts 11 and 12 described here.

The way in which the gas pressure inside the pressure cavity 17 and built up as described above is used to maintain the connection between the parts 11 and 12 which will now be explained.

In the embodiment according to FIGS. 1 and 2, a hollow cylindrical body 24 of deformable material, e.g. a plastic, extends inside and along the circumference of the narrowed portion 18 of the pressure cavity 17. As will be clear more particularly from FIG. 2, the telescopic part 13 of the front part 11 of the projectile body has three boreholes 25 extending continuously and uniformly over its periphery, such boreholes containing metal balls 26 which, in the position shown in FIGS. 1 and 2, bear at their radially inward end against the cylindrical body 24 and, at their outer end, project outside the boreholes 25. As will be seen more particularly from the left of FIG. 1, the rear part 12 of the projectile body has an oblique abutment surface 27 inside the cavity 14. As will be seen from the right in FIG. 1, a ball 26 bearing against the body 24 at its radially inwardly situated side and against the abutment surface 27 at its radially outwardly situated side, forms, by its axial enclosure within the associated bore 25, a member that keeps the two parts 11 and 12 of the projectile body 1 interlocked or connected to one another. Two forces directed in opposition to one another act on each ball 26 radially in these conditions.

Inter alia as a result of the air resistance and their mass distribution, the two parts 11 and 12 of the projectile body experience different forces from one another in the axial direction such that an axial force results which is directed towards separating or disconnecting the two parts. This force is transmitted via the oblique abutment surfce 27 to the balls 26, so that as a result of their enclosure within the boreholes 25 there is always a radially inward force component. On the other hand, the cylindrical body 24 is internally subjected to the gas pressure inside the pressure cavity 17 and the narrowed portion 18, with the result of a radially outwardly directed force component which also acts on the balls 26 at the side of the boreholes 25.

The value selected for the gas pressure inside the pressure cavity 17 and the narrowed portion 18 is such that the said radially outwardly directed force component acting on the balls 26 is greater, during the projectile trajectory extending over the excerise distance, than the radial inward force component exerted on the balls 26 via the abutment surface 27. After the gas pressure inside the pressure cavity 17 has been leaked away via leakage ducts 23 so that the said difference in forces changes sign, so that the resulting radial force is then directed inwardly on the balls, the balls are moved by the abutment surface 27 in the radially inward direction, and in so doing they press the cylindrical body 24 radially inwards. As soon as the balls have been released from the abutment surface 27 (not shown in the drawing) the connection between the projectile body parts 11 and 12 is unlocked. The portion 13 of the front part 11 can then move unobstructedly out of the cavity 14 of the rear part 12, and this also occurs as the result of the abovementioned difference between the axial forces acting on the two parts 11 and 12.

As soon as the two parts 11 and 12 have separated from one another as described hereinbefore, they come into unstable flight and very rapidly perform a tumbling movement. In these conditions the two parts experience a greatly increased air resistance, so that they are rapidly braked and drop to the ground.

With regard to the abovementioned component 1–23, the construction of the embodiment according to FIG. 3 corresponds at least in principle completely to the practice projectile according to FIG. 1. Instead of the construction with the cylindrical body 24, boreholes 25, balls 26 and abutment surface 27, the embodiment according to FIG. 3 uses a construction in which a ring 36 of resilient material, e.g. plastics, is accommodated in a circumferential groove communicating via radial ducts 34 with the narrowed portion 18 of the pressure cavity. Ring 36 is subjected to an outward pressure via the radial ducts 34 by the gas pressure inside the pressure cavity 17 and the narrowed portion 18, so that said ring expands and its outer circumference presses against the wall 37 of the cavity 14. The connection between the two parts 11 and 12 of the projectile body in the embodiment according to FIG. 3 thus takes place as a result of friction between the ring 36 and the wall 37. It will be apparent that the resulting frictional force drops to below the value required for disconnection of the two parts 11 and 12 after the intended trajectory has been covered, i.e. the practice distance, as a result of the projectile in a similar manner to the embodiment according to FIGS. 1 and 2. After the two parts 11 and 12 have been separated, they again perform a tumbling motion and are so braked by the then intensively increasing air resistance that they rapidly drop to the ground.

With regard to the construction of the exercise projectile shown in FIG. 3, the member 36 need not necessarily be formed by a ring of elastic material, but may, for example, also be constructed as a diaphragm or bellows. Other embodiments of the friction member 36 are also possible.

It will be apparent from the foregoing, the invention provides an exercise projectile of the discarding sabot type which, after a predetermined trajectory generally following from a required exercise distance, separates into two or more parts in such a manner that the resulting change in the ballistic behaviour of the projectile prevents or counteracts any further flight. The parts concerned come into a tumbling movement in these conditions so that as a result of the then intensively increasing air resistance they are rapidly braked and drop to the ground. Although the two embodiments described hereinbefore and illustrated in the drawing consist only of two such parts, it will be apparent that the invention is not restricted thereto. Projectile bodies consisting of more than two parts which are interconnected during the predetermined trajectory and then disconnected in one or more of the ways described hereinbefore may be used. It should also be noted that the invention is not restricted to an exercise projectile whose parts are pneumatically connected and disconnected. We have already referred hereinbefore to the possibility of having at least one of these functions carried out pyrotechnically, in which case the pneumatic components 17–23 of the embodiments described hereinbefore are replaced, for example, by a pyrotechnic chain with a comparable effect.

The invention is not restricted to exercise projectiles of the above-described type, but also relates to any ammunition, more particularly exercise ammunition provided with such an exercise projectile.

I claim:

1. An exercise projectile comprising, in combination:
a projectile body having at least two parts provided with interengaging portions;
separable sabot means having plural components engaging said parts for connecting said parts prior to firing the projectile and for releasing said parts by separation of said components a short period of time subsequent to said firing; and
time delay connector means cooperating with said interengaging portions for establishing a temporary connection between said parts in response to said firing of the projectile, and including delay means for terminating said temporary connection subsequent to said short period of time.

2. An exercise projectile as defined in claim 1 wherein said time delay connector means comprises friction means responsive to propellant gas pressure for frictionally connecting said interengaging portions.

3. An exercise projectile as defined in claim 2 wherein said delay means comprises bleed means for dissipating the effect of said friction means in response to separation of said components of the separable sabot means.

4. An exercise projectile as defined in claim 3 wherein said friction means comprises a plurality of balls carried by one part and are urged into frictional connecting engagement with the other part in response to propellant gas pressure.

5. An exercise projectile as defined in claim 3 wherein said friction means comprises an incompressible ring carried by one part and urged into frictional connecting engagement with the other part in response to propellant gas pressure.

6. An exercise projectile as defined in claim 1 wherein one of said parts is provided with a propellant gas pressure accumulating chamber and said body includes means for unidirectionally accumulating propellant gas in said chamber during firing.

7. An exercise projectile as defined in claim 6 wherein said time delay connector means comprises friction means responsive to pressure of said accumulated propellant gas for frictionally connecting said interengaging parts.

8. An exercise projectile as defined in claim 7 wherein said delay means comprises bleed means for bleeding off said accumulated propellant gas in response to separation of said components of the separable sabot means.

9. An exercise projectile as defined in claim 8 wherein said friction means comprises a plurality of balls carried by one part and are urged into frictional connecting engagement with the other part in response to propellant gas pressure.

10. An exercise projectile as defined in claim 8 wherein said friction means comprises an incompressible ring carried by one part and urged into frictional connecting engagement with the other part in response to propellant gas pressure.

* * * * *